US005862783A

United States Patent [19]

Lewis

[11] Patent Number: 5,862,783

[45] Date of Patent: Jan. 26, 1999

[54] VARIABLE ANGLE CAMSHAFT

[76] Inventor: Henry E. Lewis, 805 Northgate Dr., Uniondale, N.Y. 11553

[21] Appl. No.: 41,246

[22] Filed: Mar. 12, 1998

[51] Int. Cl.[6] ..... F01L 13/00

[52] U.S. Cl. ..... 123/90.17; 123/90.31; 123/90.6; 74/568 R

[58] Field of Search ..... 123/90.15, 90.17, 123/90.18, 90.31, 90.6; 74/568 R, 567

[56] References Cited

U.S. PATENT DOCUMENTS

| | | | |
|---|---|---|---|
| 4,498,352 | 2/1985 | Hedelin | 74/568 R |
| 4,787,345 | 11/1988 | Thoma | 123/90.17 |
| 5,111,780 | 5/1992 | Hannibal | 123/90.17 |
| 5,161,429 | 11/1992 | Elrod et al. | 74/567 |
| 5,253,622 | 10/1993 | Bornstein et al. | 123/90.17 |
| 5,417,186 | 5/1995 | Elrod et al. | 123/90.17 |
| 5,441,021 | 8/1995 | Moore, II | 123/90.17 |
| 5,505,168 | 4/1996 | Nagai et al. | 123/90.17 |
| 5,509,384 | 4/1996 | Schmid | 123/90.17 |
| 5,704,317 | 1/1998 | Barth | 123/90.17 |
| 5,746,166 | 5/1998 | Valasopoulos | 123/90.6 |

*Primary Examiner*—Weilun Lo

[57] ABSTRACT

A new variable angle camshaft for providing improved fuel economy and better performance for motorists. The inventive device includes a cylindrical housing having a partially hollow interior. The thick rear wall has a channel running therethrough. A forward end of the housing has a threaded collar opening into the partially hollow interior. The threaded collar is coupled with a line from an oil pump. A piston is slidably disposed within the partially hollow interior of the housing. A spring is disposed between the piston and an interior surface of the thick rear wall of the housing. The piston has a shaft extending outwardly therefrom into the channel of the housing. A cam shaft is provided including an outer housing and a movable interior segment. The cam shaft has an outer end extending inwardly of the channel of the cylindrical housing in a proximate relationship to the shaft of the piston. An inner end of the movable interior segment has a spring disposed thereon. The outer housing has a gear disposed thereon for engaging a crankshaft gear. The cam shaft has a cam shaft lobe disposed thereon. The cam shaft lobe includes an outer fixed lobe and an inner movable lobe. The outer fixed lobe is coupled with the outer housing. The inner movable lobe is coupled with the movable interior segment.

5 Claims, 3 Drawing Sheets

FIG 1
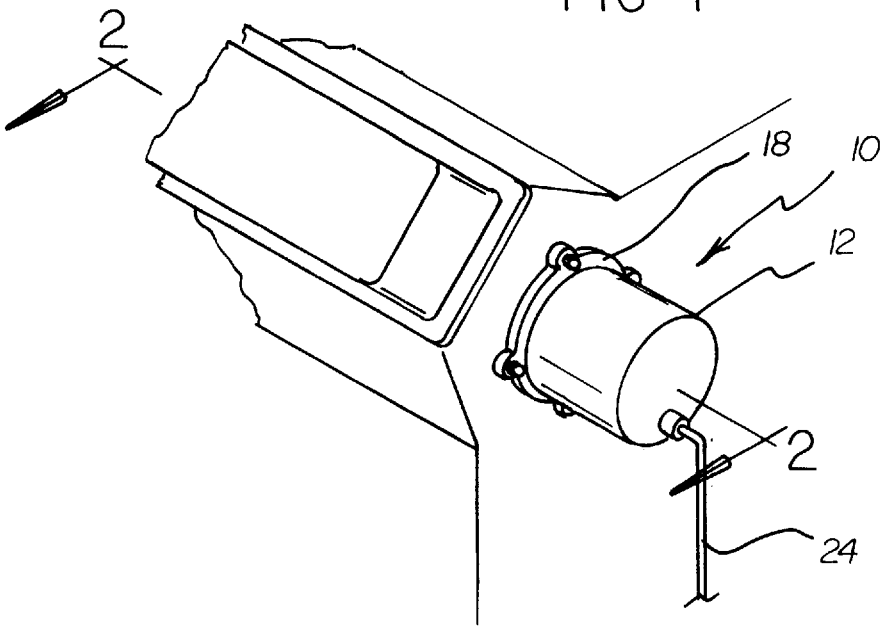
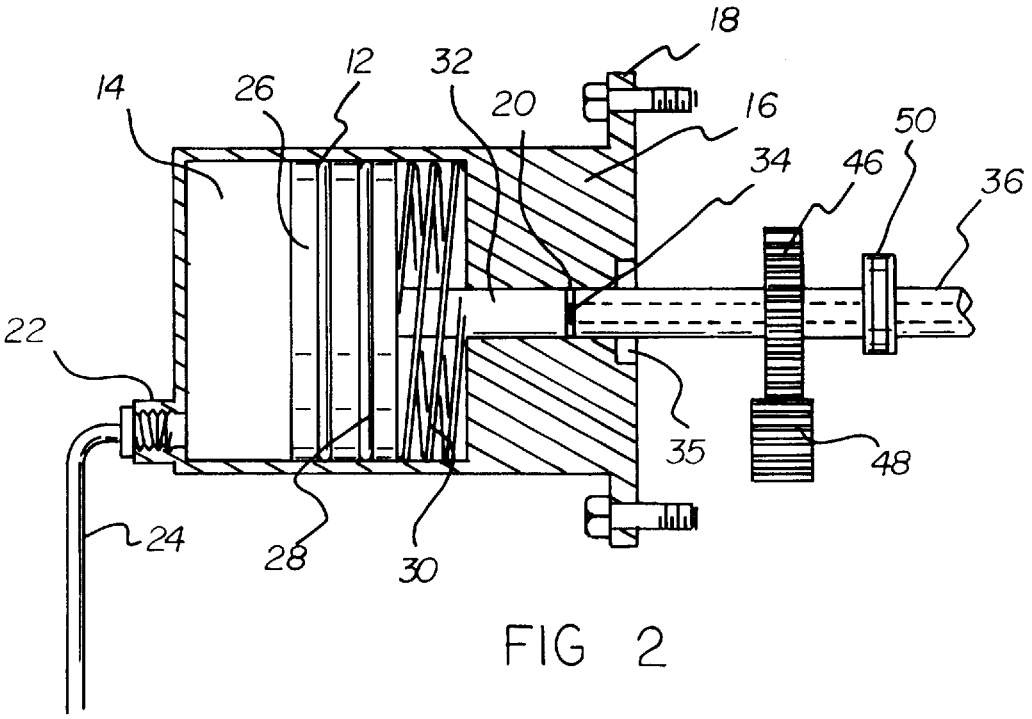
FIG 2

VARIABLE ANGLE CAMSHAFT

BACKGROUND OF THE INVENTION

1. Field of the Invention

The present invention relates to variable cams and more particularly pertains to a new variable angle camshaft for providing improved fuel economy and better performance for motorists.

2. Description of the Prior Art

The use of variable cams is known in the prior art. More specifically, variable cams heretofore devised and utilized are known to consist basically of familiar, expected and obvious structural configurations, notwithstanding the myriad of designs encompassed by the crowded prior art which have been developed for the fulfillment of countless objectives and requirements.

Known prior art variable cams include U.S. Pat. No. 5,161,429 to Elrod et al.; U.S. Pat. No. 4,522,085 to Kane; U.S. Pat. No. 4,870,872 to Parsons; U.S. Pat. No. 4,498,352 to Hedelin; U.S. Pat. No. 5,129,407 to Phillips; and U.S. Pat. No. 5,253,622 to Bornstein et al.

While these devices fulfill their respective, particular objectives and requirements, the aforementioned patents do not disclose a new variable angle camshaft. The inventive device includes a cylindrical housing having a partially hollow interior. The thick rear wall has a channel running therethrough. A forward end of the housing has a threaded collar opening into the partially hollow interior. The threaded collar is coupled with a line from an oil pump. A piston is slidably disposed within the partially hollow interior of the housing. A spring is disposed between the piston and an interior surface of the thick rear wall of the housing. The piston has a shaft extending outwardly therefrom into the channel of the housing. A cam shaft is provided including an outer housing and a movable interior segment. The cam shaft has an outer end extending inwardly of the channel of the cylindrical housing in a proximate relationship to the shaft of the piston. An inner end of the movable interior segment has a spring disposed thereon. The outer housing has a gear disposed thereon for engaging a crankshaft gear. The cam shaft has a cam shaft lobe disposed thereon. The cam shaft lobe includes an outer fixed lobe and an inner movable lobe. The outer fixed lobe is coupled with the outer housing. The inner movable lobe is coupled with the movable interior segment.

In these respects, the variable angle camshaft according to the present invention substantially departs from the conventional concepts and designs of the prior art, and in so doing provides an apparatus primarily developed for the purpose of providing improved fuel economy and better performance for motorists.

SUMMARY OF THE INVENTION

In view of the foregoing disadvantages inherent in the known types of variable cams now present in the prior art, the present invention provides a new variable angle camshaft construction wherein the same can be utilized for providing improved fuel economy and better performance for motorists.

The general purpose of the present invention, which will be described subsequently in greater detail, is to provide a new variable angle camshaft apparatus and method which has many of the advantages of the variable cams mentioned heretofore and many novel features that result in a new variable angle camshaft which is not anticipated, rendered obvious, suggested, or even implied by any of the prior art variable cams, either alone or in any combination thereof.

To attain this, the present invention generally comprises a cylindrical housing having a partially hollow interior. The housing has a thick rear wall with a peripheral mounting flange disposed thereon. The thick rear wall has a channel running therethrough. A forward end of the housing has a threaded collar opening into the partially hollow interior. The threaded is coupled with a line from an oil pump. A piston is slidably disposed within the partially hollow interior of the housing. The piston has a pair of O-rings disposed therearound in a spaced relationship. A spring is disposed between the piston and an interior surface of the thick rear wall of the housing. The piston has a shaft extending outwardly therefrom into the channel of the housing. The shaft has an outwardly extending end portion. A cam shaft is provided including an outer housing and a movable interior segment. The cam shaft has an outer end extending inwardly of the channel of the cylindrical housing. An outer end of the movable interior segment has an outwardly extending end portion disposed in a proximate relationship to the outwardly extending end portion of the shaft of the piston. An inner end of the movable interior segment has a spring disposed thereon. The outer housing has a gear disposed thereon for engaging a crankshaft gear. The cam shaft has a cam shaft lobe disposed thereon. The cam shaft lobe includes an outer fixed lobe and an inner movable lobe. The outer fixed lobe is coupled with the outer housing. The inner movable lobe is coupled with the movable interior segment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new variable angle camshaft apparatus and method which has many of the advantages of the variable cams mentioned heretofore and many novel features that result in a new variable angle camshaft which is not anticipated, rendered obvious, suggested, or even implied by any of the prior art variable cams, either alone or in any combination thereof.

It is another object of the present invention to provide a new variable angle camshaft which may be easily and efficiently manufactured and marketed.

It is a further object of the present invention to provide a new variable angle camshaft which is of a durable and reliable construction.

An even further object of the present invention is to provide a new variable angle camshaft which is susceptible of a low cost of manufacture with regard to both materials and labor, and which accordingly is then susceptible of low prices of sale to the consuming public, thereby making such variable angle camshaft economically available to the buying public.

Still yet another object of the present invention is to provide a new variable angle camshaft which provides in the apparatuses and methods of the prior art some of the advantages thereof, while simultaneously overcoming some of the disadvantages normally associated therewith.

Still another object of the present invention is to provide a new variable angle camshaft for providing improved fuel economy and better performance for motorists.

Yet another object of the present invention is to provide a new variable angle camshaft which includes a cylindrical housing having a partially hollow interior. The thick rear wall has a channel running therethrough. A forward end of the housing has a threaded collar opening into the partially hollow interior. The threaded collar is coupled with a line from an oil pump. A piston is slidably disposed within the partially hollow interior of the housing. A spring is disposed between the piston and an interior surface of the thick rear wall of the housing. The piston has a shaft extending outwardly therefrom into the channel of the housing. A cam shaft is provided including an outer housing and a movable interior segment. The cam shaft has an outer end extending inwardly of the channel of the cylindrical housing in a proximate relationship to the shaft of the piston. An inner end of the movable interior segment has a spring disposed thereon. The outer housing has a gear disposed thereon for engaging a crankshaft gear. The cam shaft has a cam shaft lobe disposed thereon. The cam shaft lobe includes an outer fixed lobe and an inner movable lobe. The outer fixed lobe is coupled with the outer housing. The inner movable lobe is coupled with the movable interior segment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new variable angle camshaft according to the present invention.

FIG. 2 is a cross-sectional view of the present invention as taken along line 2—2 of FIG. 1.

DESCRIPTION OF THE PREFERRED EMBODIMENT

Figure 3:
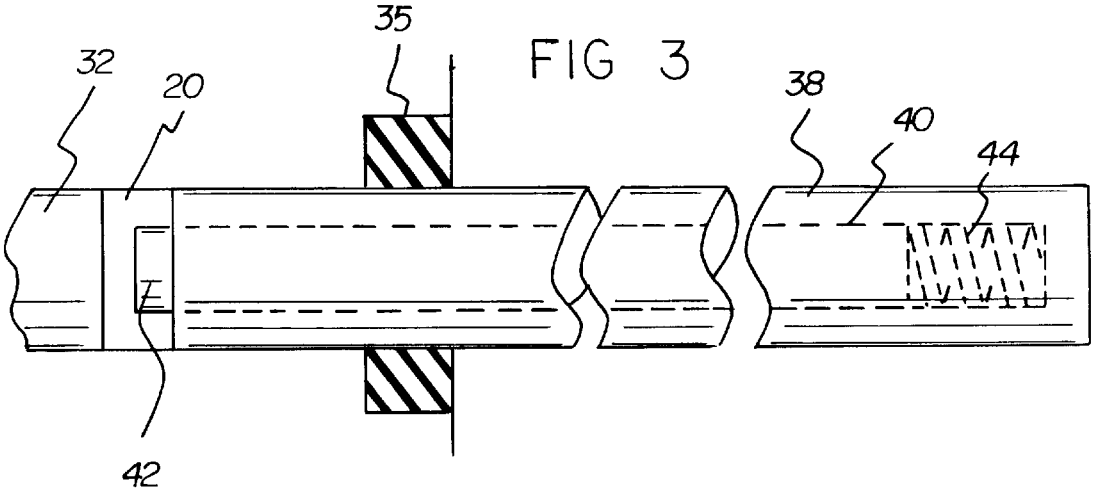
FIG. 3 is a partial cross-sectional view of the present invention illustrated in FIG. 2.
Figure 4:
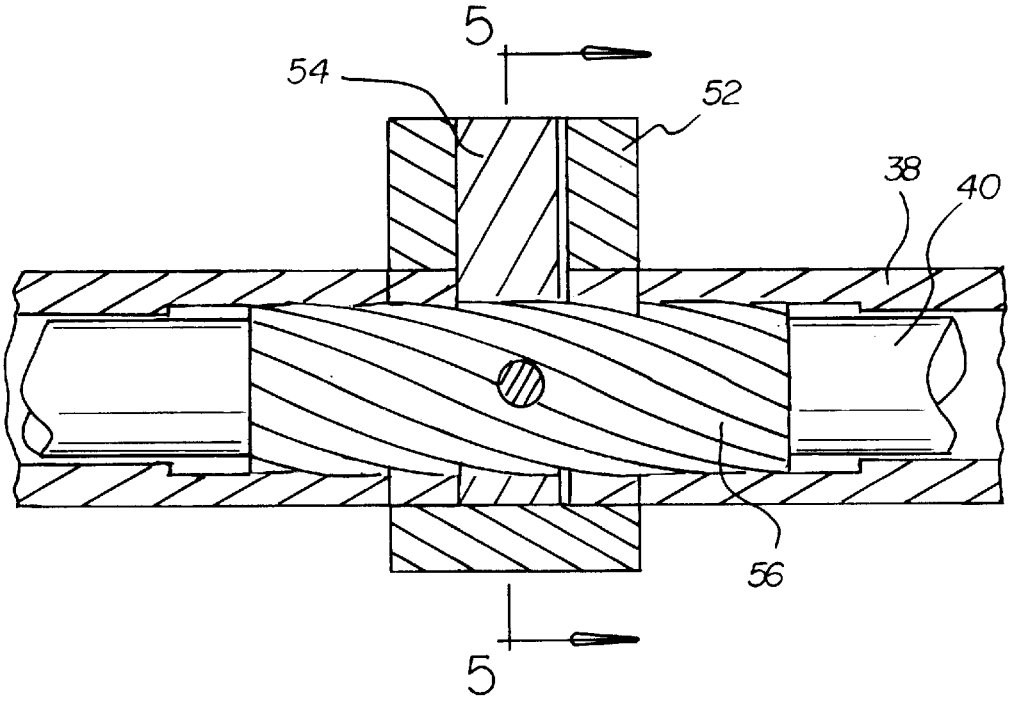
FIG. 4 is a partial cross-sectional view of the present invention illustrated in FIG. 2.
Figure 5:
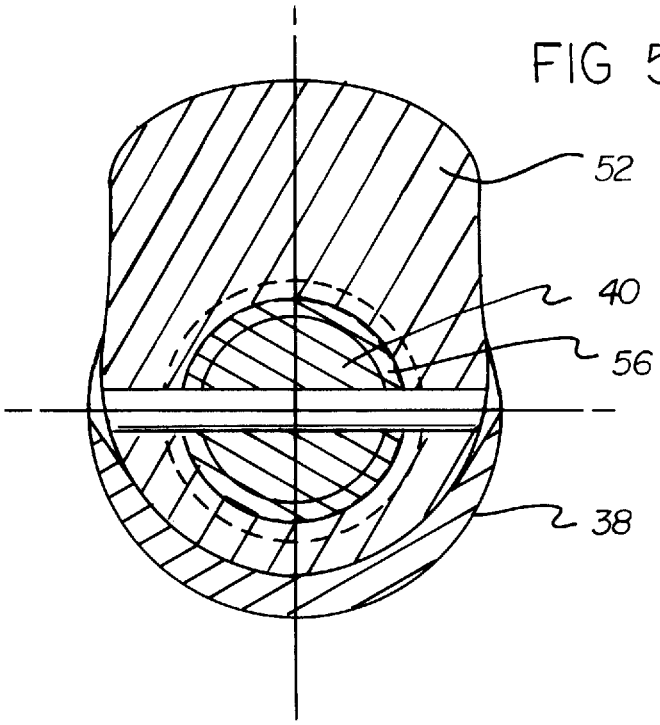
FIG. 5 is a cross-sectional view of the present invention as taken along line 5—5 of FIG. 4.

With reference now to the drawings, and in particular to FIGS. 1 through 6 thereof, a new variable angle camshaft embodying the principles and concepts of the present invention and generally designated by the reference numeral 10 will be described.

As best illustrated in FIGS. 1 through 6, the variable angle camshaft 10 comprises a cylindrical housing 12 having a partially hollow interior 14. The housing 12 has a thick rear wall 16 with a peripheral mounting flange 18 disposed thereon. The thick rear wall 16 has a channel 20 running therethrough. A forward end of the housing 12 has a threaded collar 22 opening into the partially hollow interior 14. The threaded collar 22 is coupled with a line 24 from an oil pump or transmission pump.

A piston 26 is slidably disposed within the partially hollow interior 14 of the housing 12. The piston 26 has a pair of O-rings 28 disposed therearound in a spaced relationship. A spring 30 is disposed between the piston 26 and an interior surface of the thick rear wall 16 of the housing 12. The piston 26 has a shaft 32 extending outwardly therefrom into the channel 20 of the housing 12. The shaft 32 has an outwardly extending end portion 34. A seal 35 is disposed at an end of the channel 20.

A cam shaft 36 is provided including an outer housing 38 and a movable interior segment 40. The cam shaft 36 has an outer end extending inwardly of the channel 20 of the cylindrical housing 12. An outer end of the movable interior segment 40 has an outwardly extending end portion 42 disposed in a proximate relationship to the outwardly extending end portion 34 of the shaft 32 of the piston 26. An inner end of the movable interior segment 40 has a spring 44 disposed thereon. The outer housing 38 has a gear 46 disposed thereon for engaging a crankshaft gear 48. The cam shaft 36 has a cam shaft lobe 50 disposed thereon. The cam shaft lobe 50 includes an outer fixed lobe 52 and an inner movable lobe 54. The outer fixed lobe 52 is coupled with the outer housing 38. The inner movable lobe 54 is coupled with the movable interior segment 40.

In use, oil will be forced into the cylindrical housing 12 from the transmission or oil pump to push the piston 26 inwardly. The shaft 32 at the end of the piston 26 would have a polished steel end 34 that contacts another polished steel end 42 of the cam shaft 36. The force from the piston 26 would press on the movable interior segment 40 of the cam shaft 36, which would have a spiral 56 milled onto it. Each lobe 50 of the camshaft 38 would consist of two parts, the outer fixed lobe 52 and the inner movable lobe 54. The inner movable lobe 54 would be milled with grooves to accept the movable interior segment 40, which has a spiral 56 at that location. As the interior segment 40 is pushed inwardly by the piston shaft 32 due to the spiral 56, the inner movable lobe 54 would move outwardly a predetermined distance.

Figure 6:
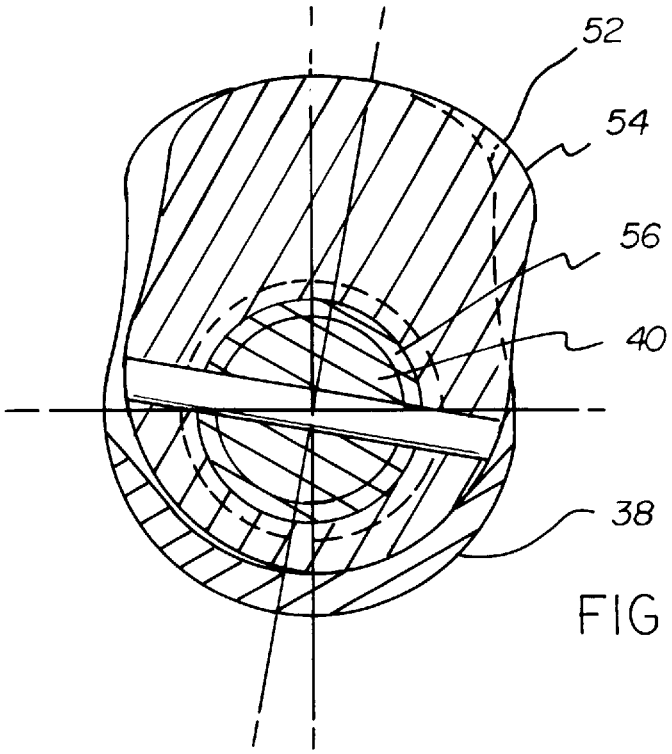
FIG. 6 is a cross-sectional view of the present invention illustrated with fluid pressure.

Note FIG. 6. The distance the interior segment 40 travels would determine the angle in degrees the inner movable lobe 54 moves. When relaxed, there would be a 0.001 inch gap between the polished steel ends 34,42 of the piston shaft 32 and the interior segment 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new variable angle camshaft for providing improved fuel economy and better performance for motorists comprising, in combination:

a cylindrical housing having a partially hollow interior, the housing having a thick rear wall with a peripheral mounting flange disposed thereon, the thick rear wall having a channel running therethrough, a forward end of the housing having a threaded collar opening into the partially hollow interior, the threaded collar being coupled with a line from an oil pump;

a piston slidably disposed within the partially hollow interior of the housing, the piston having a pair of O-rings disposed therearound in a spaced relationship, a spring disposed between the piston and an interior surface of the thick rear wall of the housing, the piston having a shaft extending outwardly therefrom into the channel of the housing, the shaft having an outwardly extending end portion;

a cam shaft including an outer housing and a movable interior segment, the cam shaft having an outer end extending inwardly of the channel of the cylindrical housing, an outer end of the movable interior segment having an outwardly extending end portion disposed in a proximate relationship to the outwardly extending end portion of the shaft of the piston, an inner end of the movable interior segment having a spring disposed thereon, the outer housing having a gear disposed thereon for engaging a crankshaft gear, the cam shaft having a cam shaft lobe disposed thereon, the cam shaft lobe including an outer fixed lobe and an inner movable lobe, the outer fixed lobe coupled with the outer housing, the inner movable lobe coupled with the movable interior segment.

2. A new variable angle camshaft for providing improved fuel economy and better performance for motorists comprising, in combination:

a cylindrical housing having a partially hollow interior, the housing having a thick rear wall having a channel running therethrough, a forward end of the housing having a threaded collar opening into the partially hollow interior, the threaded collar being coupled with a line from an oil pump;

a piston slidably disposed within the partially hollow interior of the housing, a spring disposed between the piston and an interior surface of the thick rear wall of the housing, the piston having a shaft extending outwardly therefrom into the channel of the housing;

a cam shaft including an outer housing and a movable interior segment, the cam shaft having an outer end extending inwardly of the channel of the cylindrical housing, an outer end of the movable interior segment disposed in a proximate relationship to a free end of the shaft of the piston, an inner end of the movable interior segment having a spring disposed thereon, the outer housing having a gear disposed thereon for engaging a crankshaft gear, the cam shaft having a cam shaft lobe disposed thereon, the cam shaft lobe including an outer fixed lobe and an inner movable lobe, the outer fixed lobe coupled with the outer housing, the inner movable lobe coupled with the movable interior segment.

3. The variable angle camshaft as set forth in claim 2 wherein the housing has a thick rear wall with a peripheral mounting flange disposed thereon.

4. The variable angle camshaft as set forth in claim 2 wherein the piston has a pair of O-rings disposed therearound in a spaced relationship.

5. The variable angle camshaft as set forth in claim 2 wherein the shaft of the piston has an outwardly extending end portion including said free end, and an outer end of the movable interior segment has an outwardly extending end portion disposed in a proximate relationship to the outwardly extending end portion of the shaft of the piston.

* * * * *